US008714543B2

(12) United States Patent
Matsushima et al.

(10) Patent No.: US 8,714,543 B2
(45) Date of Patent: May 6, 2014

(54) SHEET FEEDING APPARATUS AND IMAGE FORMING APPARATUS

(75) Inventors: Akira Matsushima, Susono (JP); Shunsuke Okazaki, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 119 days.

(21) Appl. No.: 13/435,571

(22) Filed: Mar. 30, 2012

(65) Prior Publication Data

US 2012/0256367 A1 Oct. 11, 2012

(30) Foreign Application Priority Data

Apr. 8, 2011 (JP) ..... 2011-086661

(51) Int. Cl.
*B65H 1/26* (2006.01)

(52) U.S. Cl.
USPC ..... 271/157; 271/147; 271/152

(58) Field of Classification Search
USPC ..... 271/147, 152, 157
See application file for complete search history.

(56) References Cited

U.S. PATENT DOCUMENTS

| | | | | |
|---|---|---|---|---|
| 6,643,480 | B2 | 11/2003 | Kuwata et al. | |
| 6,871,848 | B2 | 3/2005 | Matsushima et al. | |
| 7,766,320 | B2 * | 8/2010 | Baena et al. | 271/147 |
| 7,971,868 | B2 | 7/2011 | Matsushima et al. | |
| 8,203,131 | B2 * | 6/2012 | Silverman et al. | 250/559.3 |
| 2011/0024969 | A1 | 2/2011 | Matsushima et al. | |

FOREIGN PATENT DOCUMENTS

| | | |
|---|---|---|
| JP | 2007-197204 | 8/2007 |

* cited by examiner

*Primary Examiner* — Michael McCullough
*Assistant Examiner* — Howard Sanders
(74) *Attorney, Agent, or Firm* — Fitzpatrick, Cella, Harper & Scinto

(57) ABSTRACT

The present invention relates a sheet feeding apparatus with a lifting and lowering mechanism in a sheet deck 2, which includes abutting portions 101*a* to 101*d* which makes wire hanging portions 64*a* to 64*d* of a sheet stacking table 52 abut thereon and makes the sheet stacking table 52 lockable with respect to a storing portion 61. The mechanism also includes a pulse motor 27 and a one-way clutch 40. A controller 5 drives the pulse motor 27 to be rotated in a lifting direction of the sheet stacking table 52, further drives the pulse motor 27 to be rotated in the same direction even after the wire hanging portions 64*a* to 64*d* abut on the abutting portions 101*a* to 101*d* to cause the pulse motor 27 to step out, and renders the pulse motor 27 non-conductive. Thus, the wire hanging portions is locked to abut on the abutting portions.

10 Claims, 13 Drawing Sheets

SHEET FEEDING APPARATUS AND IMAGE FORMING APPARATUS

BACKGROUND OF THE INVENTION

1. Field of the Invention

The present invention relates to a sheet feeding apparatus which feeds a sheet stacked on a sheet stacking portion to an image forming portion and an image forming apparatus including the same.

2. Description of the Related Art

Some of conventional image forming apparatuses such as a printer, a copying machine, and a facsimile include a sheet feeding apparatus which feeds a sheet to an image forming portion. Such a sheet feeding apparatus is configured to stack a sheet on a sheet stacking table arranged in a storing portion to enable lifting and lowering, lift the sheet stacking table to a position enabling sheet feeding, and thereafter send the sheet toward the image forming portion by a feeding roller.

For example, the sheet feeding apparatus is provided with a sheet surface detecting sensor which detects a height position of an uppermost sheet stacked on the sheet stacking table. This sheet surface detecting sensor is OFF when the uppermost sheet is at a height position enabling feeding and ON when the uppermost sheet is lower than the height position enabling feeding, for example.

When the sheet surface detecting sensor is ON, a controller is configured to drive a motor, e.g., to rotate a reel drum, and reel a wire attached to the sheet stacking table. This causes the sheet stacking table to lift, and when the uppermost sheet reaches the height position enabling feeding, the sheet surface detecting sensor is OFF to stop driving, and the sheet stacking table stops. This operation is repeated during sheet feeding to maintain the uppermost sheet at the height position enabling sheet feeding.

A recent requirement for improvement in efficiency of physical distribution promotes reduction in size and weight of packing materials, which brings about a tendency toward an increase in vibration and impact applied to an apparatus main body at the time of transporting the image forming apparatus including the sheet feeding apparatus. Thus, the sheet stacking table of the sheet feeding apparatus may be vibrated and damaged, and the sheet stacking table may collide with the feeding roller which feeds a sheet and break the roller portion.

To deal with this, a configuration is proposed in the sheet feeding apparatus, in which a lock member for transportation is provided to lock the sheet stacking table to prevent scratches and breakage caused by vibration and impact at the time of transportation. This sheet feeding apparatus has a lift hole vertically penetrating the sheet stacking table provided to be vertically movable on an accommodating surface accommodating a sheet and has a locking hole penetrating the lift hole and an opposed part on the accommodating surface when a lift plate is located along the accommodating surface. At the time of transportation, a stopper as the lock member is engaged with the lift hole and the locking hole, and a supporting plate of the stopper presses the sheet stacking table to prevent the sheet stacking table from moving upward from the accommodating surface and regulates unnecessary movement of the sheet stacking table (refer to Japanese Patent Laid-Open No. 2007-197204).

However, in a case of using the lock member for transportation, the lock member needs to be attached at the time of assembly and inevitably needs to be detached before use by a user. In this case, an attaching and detaching work of the lock member is required and is troublesome. In addition, in a case where detachment of the lock member is omitted before use, the sheet stacking table is lifted in a state where the lock member is attached, which may cause scratching and breakage of the sheet stacking table and peripheral members.

The present invention provides a sheet feeding apparatus which enables simple and reliable locking of a sheet stacking portion at the time of transportation and which enables extremely simple unlocking at the time of use and an image forming apparatus including the same.

SUMMARY OF THE INVENTION

The present invention provides a sheet feeding apparatus including a storing portion which has a sheet stacking portion to enable lifting and lowering, a feeding portion which feeds a sheet stacked on the sheet stacking portion, a lifting and lowering mechanism which lifts and lowers the sheet stacking portion, and a controller which controls the lifting and lowering mechanism. The lifting and lowering mechanism includes an abutting portion which makes the lifting sheet stacking portion abut thereon at a predetermined position and makes the sheet stacking portion lockable with respect to the storing portion, a pulse motor which is a driving source of the lifting and lowering mechanism, and a one-way clutch which is provided between the pulse motor and the sheet stacking portion, is rotated freely in a lifting direction of the sheet stacking portion, and is locked in rotation in a lowering direction of the sheet stacking portion. The controller drives the pulse motor to be rotated in the lifting direction of the sheet stacking portion, further drives the pulse motor to be rotated in the same direction even after the sheet stacking portion abuts on the abutting portion to cause the pulse motor to step out, and thereafter renders the pulse motor non-conductive, thus to cause the sheet stacking portion to be locked by the one-way clutch in a state where the sheet stacking portion abuts on the abutting portion.

The present invention provides a sheet feeding apparatus including a storing portion which has a sheet stacking portion to enable lifting and lowering, a feeding portion which feeds a sheet stacked on the sheet stacking portion, a pulse motor which lifts and lowers the sheet stacking portion, an abutting portion which makes the sheet stacking portion lifted by the pulse motor abut thereon at a predetermined position and makes the sheet stacking portion lockable with respect to the storing portion, a one-way clutch which is provided between the pulse motor and the sheet stacking portion, is rotated freely in a lifting direction of the sheet stacking portion, and is locked in rotation in a lowering direction of the sheet stacking portion, and a controller which drives the pulse motor to be rotated in the lifting direction of the sheet stacking portion, further drives the pulse motor to be rotated in the same direction even after the sheet stacking portion abuts on the abutting portion to cause the pulse motor to step out, and thereafter renders the pulse motor non-conductive.

With a sheet feeding apparatus and an image forming apparatus according to the present invention, a sheet stacking portion can be locked reliably with a simple operation without use of a lock member or the like at the time of transportation. This dispenses with a troublesome operation such as attaching and detaching the lock member and can prevent breakage caused by omission of detachment of the lock member reliably.

Further features of the present invention will become apparent from the following description of exemplary embodiments with reference to the attached drawings.

DESCRIPTION OF THE EMBODIMENTS

Figure 2:
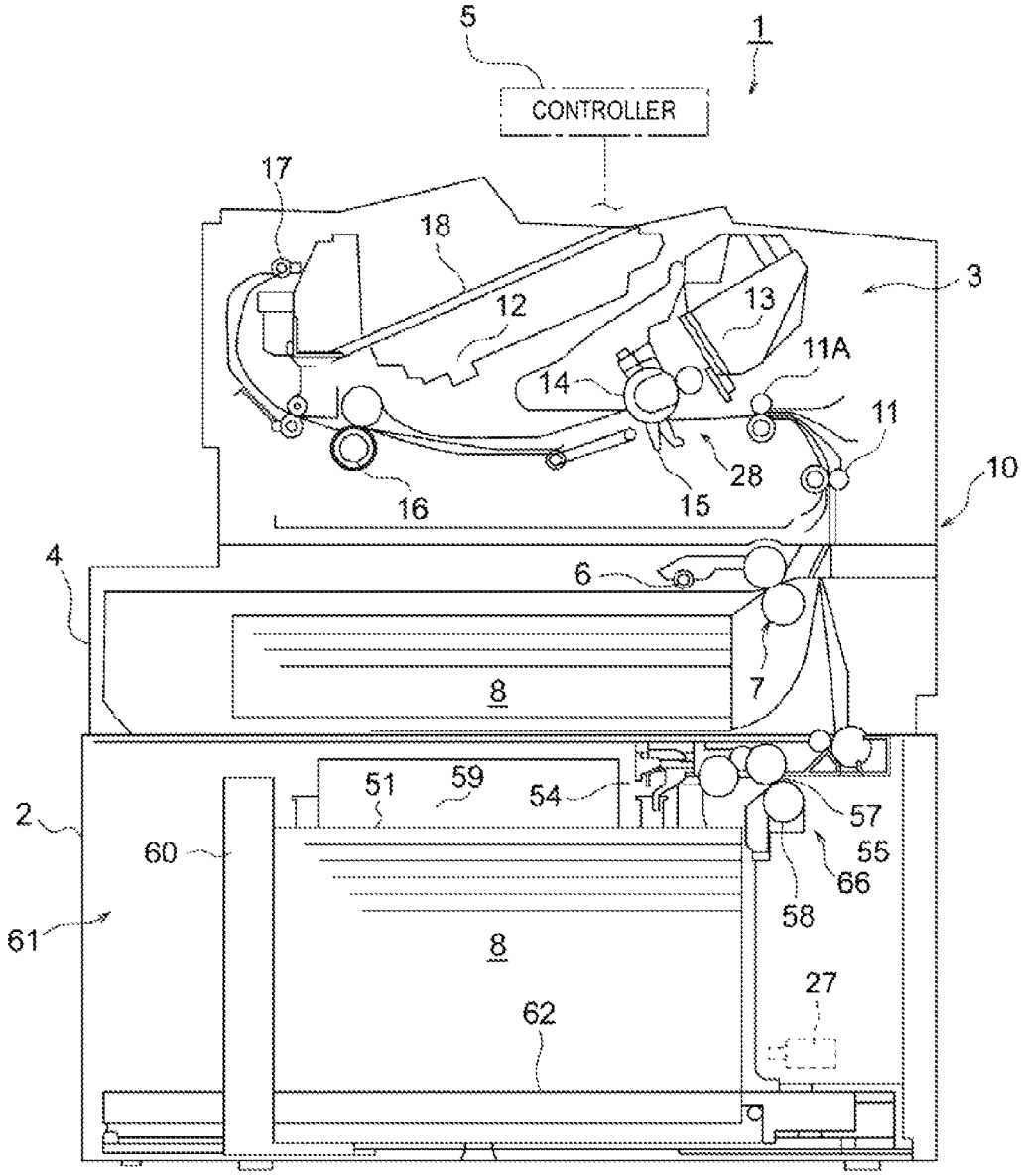
FIG. 2 is a cross-sectional view illustrating a schematic configuration of an image forming apparatus including a sheet feeding apparatus of the present embodiment.

Hereinafter, embodiments of the present invention will be described in details with reference to the drawings. FIG. 2 is a cross-sectional view illustrating a schematic configuration of an image forming apparatus 1 including a deck-type sheet feeding apparatus as an example of a sheet feeding apparatus according to an embodiment of the present invention.

As illustrated in FIG. 2, the image forming apparatus 1 includes an image forming apparatus main body (hereinafter referred to as an apparatus main body) 10, which is provided at a center portion thereof with a sheet feeding portion 4 and at a lower portion thereof with a deck-type sheet feeding apparatus (hereinafter referred to as a sheet deck) 2. The sheet feeding portion 4 includes a feeding roller 6 which abuts on and sends an uppermost sheet of a stacked sheet bundle (S) and a pair of separating rollers 7 which separates the sheet S sent by the feeding roller 6.

The apparatus main body 10 includes a controller 5 which overall controls respective portions of the image forming apparatus 1 including the sheet deck 2 and an image forming portion 3 which performs image formation to a sheet by an electrophotographic system. It is to be noted that, although the controller 5 is described as one provided for the entire image forming apparatus 1 including the sheet deck 2 in the present embodiment, the present embodiment is not limited to this. The controller 5 can be a controller configured to separate the image forming apparatus 1 into the image forming portion 3 and the sheet feeding portion 4, and the sheet deck 2.

As for feeding control, the controller 5 performs control based on information of after-mentioned sheet surface detecting flag 62 and sheet surface detecting sensor 63 so that the height of the uppermost sheet stacked on a sheet stacking table 52 may be a height enabling feeding.

The image forming portion 3 includes a photosensitive drum 14 which forms a toner image, a laser scanner 12 which irradiates the photosensitive drum 14 with light corresponding to an image signal, and a transfer roller 15 which transfers the toner image formed by the photosensitive drum 14 to a sheet S. To the image forming portion 3 is fed the sheet S from the sheet feeding portion 4 or the sheet deck 2 by the control of the controller 5 for image formation.

When an image forming operation is started in the image forming portion 3 configured as above, the laser scanner 12 first irradiates the photosensitive drum 14 with light corresponding to an image signal to form an electrostatic latent image on the photosensitive drum 14. Subsequently, the electrostatic latent image is developed with a toner stored in a toner cartridge 13 to cause the toner image (visible image) to be formed on the photosensitive drum 14.

Also, when a sheet S is fed from the sheet deck 2 as described later at the same time as such a toner image forming operation, the sheet S is conveyed to a transfer portion 28 by a conveying roller 11 and a registration roller 11A in synchronization with the image formed on the photosensitive drum 14. The transfer portion 28 includes the photosensitive drum 14 and the transfer roller 15 and is configured to transfer the toner image to the sheet S by applying a bias voltage to the transfer roller 15.

The sheet S to which the toner image has been transferred is thereafter conveyed to a fixing portion 16, is heated at this fixing portion 16 to have the toner image fixed thereon, and is further discharged to a discharging portion 18 at the upper portion of the apparatus main body 10 by a discharge roller 17.

The sheet deck 2 includes in a storing portion 61 the sheet stacking table 52 as a sheet stacking portion configured to enable to stack the sheet bundle (S) and to enable lifting and lowering, a feeding roller 54, a pair of separating rollers 66, and a conveying roller 57. In the storing portion 61 are further provided after-mentioned reference-side side regulating member 58, non-reference-side side regulating member 59, and rear-end regulating member 60. The feeding roller 54 acts as a feeding portion which feeds a sheet stacked on the sheet stacking table 52.

The pair of separating rollers 66 includes a feed roller 55 and a retard roller 56 which separate a sheet S sent from the feeding roller 54. The conveying roller 57 conveys to the apparatus main body 10 the sheet S separated and fed one by one by the pair of separating rollers 66. An after-mentioned pulse motor (stepping motor) 27 is illustrated in FIG. 2.

Figure 4:
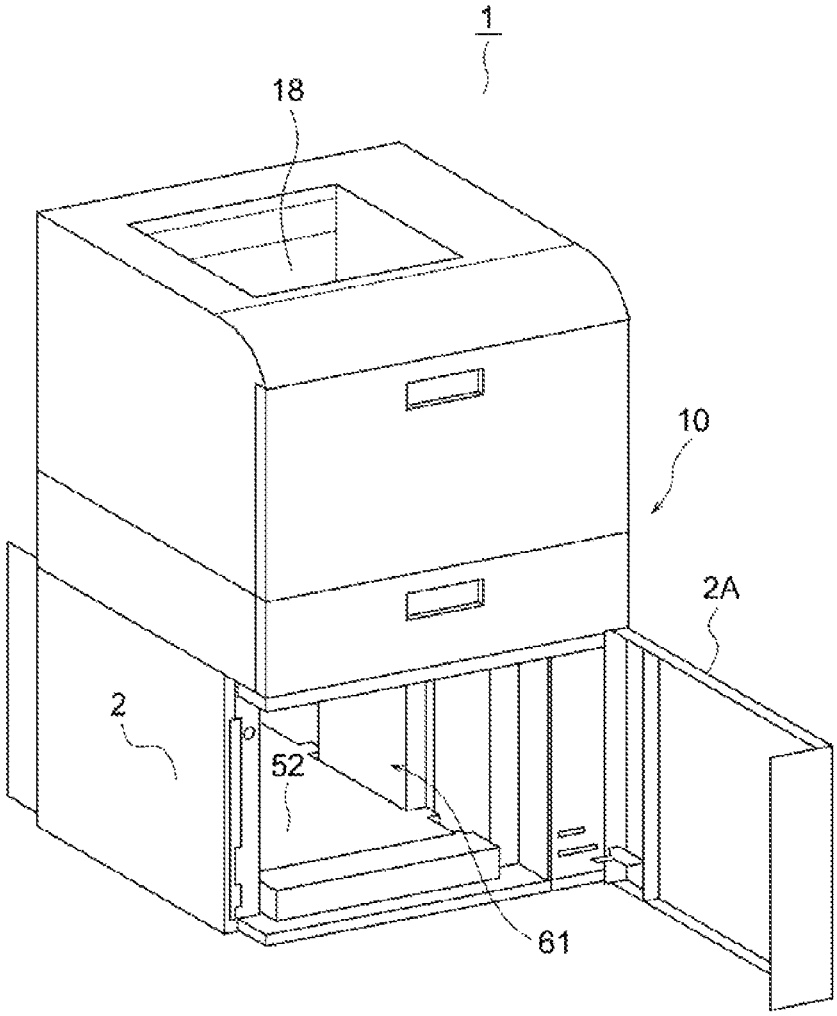
FIG. 4 is a perspective view illustrating the image forming apparatus in a door-open state.

FIG. 4 is a perspective view illustrating the image forming apparatus 1 in a door-open state. As illustrated in FIG. 4, the sheet deck 2 located on the lower side of the image forming apparatus 1 has a door 2A which is opened at the time of stacking the sheet bundle (S) on the sheet stacking table 52 to enable opening and closing. The door 2A is arranged on the front side of the apparatus main body 10 and is configured to enable a sheet S to be taken in and out from the operating side of the apparatus main body 10.

Figure 1:
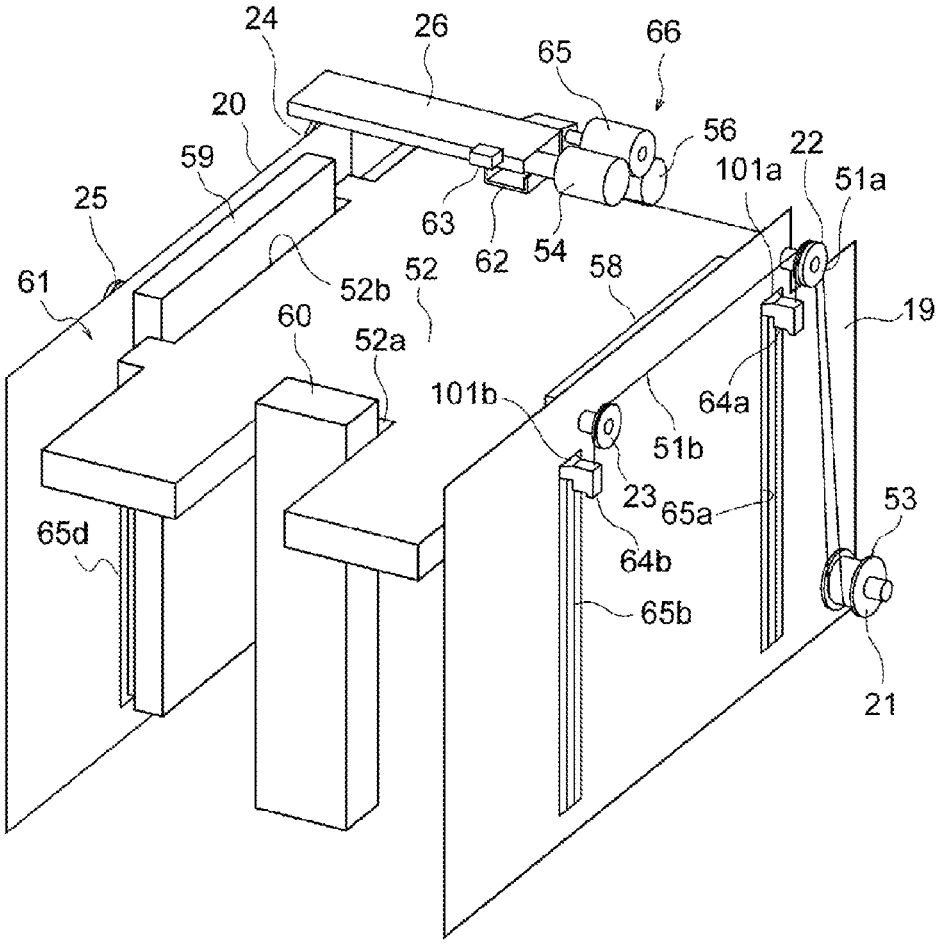
FIG. 1 is a perspective view illustrating a storing portion at the time of transportation in an embodiment of the present invention.
Figure 5:
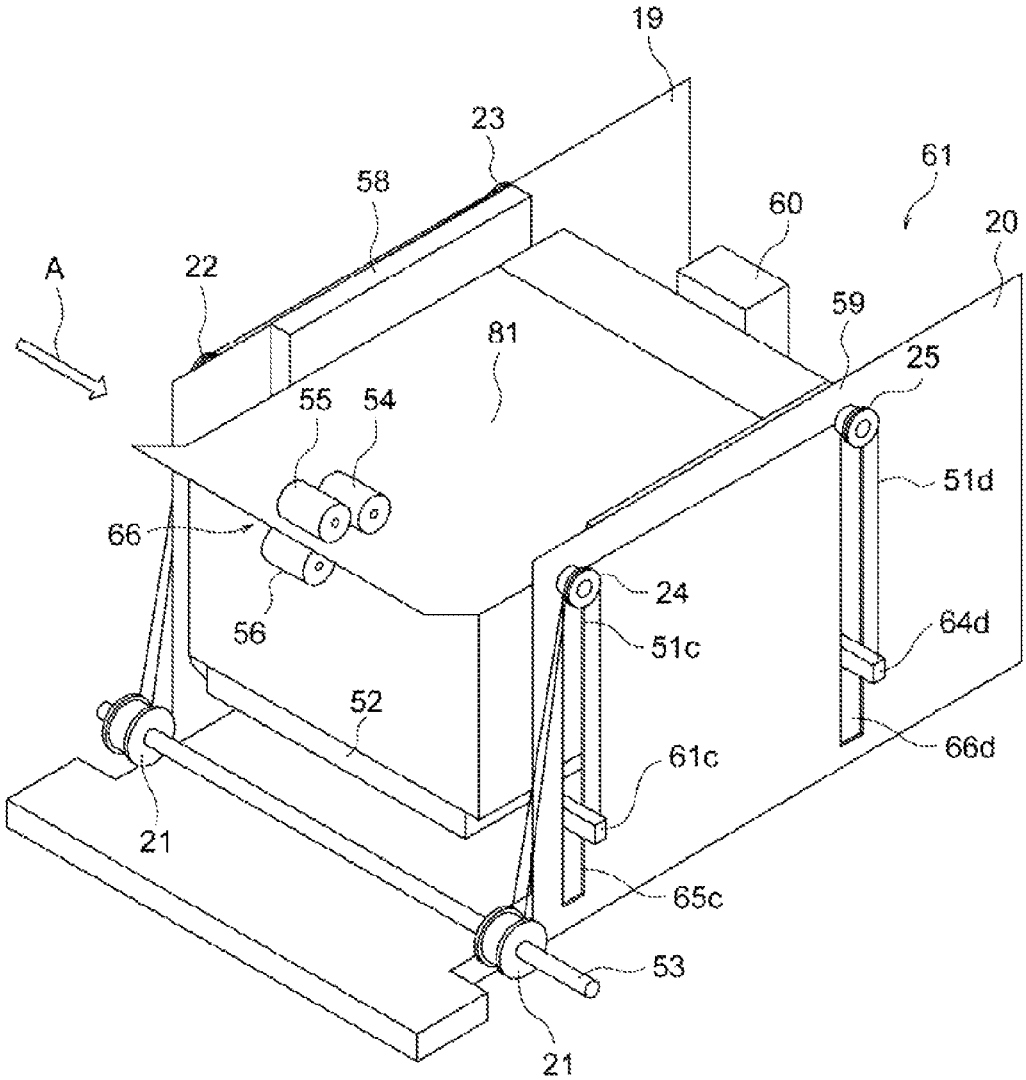
FIG. 5 is a perspective view illustrating a state of the sheet feeding apparatus at the time of feeding.

FIG. 1 is a perspective view illustrating the storing portion 61 at the time of transportation in the present embodiment, and FIG. 5 is a perspective view illustrating the storing portion 61 at the time of feeding. As illustrated in FIGS. 1 and 5, the storing portion 61 has frame plates 19 and 20 arranged to nip the sheet stacking table 52 in a state of being opposed to each other. In the frame plate 19 are formed guide grooves 65*a* and 65*b* penetrating in an elongated manner in an up-down direction in a state of being spaced as much as a predetermined distance in a right-left direction. In the frame plate 20 are formed guide grooves 65*c* and 65*d* penetrating in an elongated manner in an up-down direction in a state of being spaced as much as a predetermined distance in a right-left direction. On the upper side on the upstream in a sheet feeding direction of the sheet stacking table 52 is disposed a unit frame 26 which supports the feeding roller 54, the pair of separating rollers 66, the sheet surface detecting flag 62, and the sheet surface detecting sensor 63 integrally to a side of the apparatus main body 10. The guide grooves 65*a* to 65*d* act as guide portions which guide movement of wire hanging portions 64*a* to 64*d* of the sheet stacking table 52 and have formed at the upper end portions thereof abutting portions 101*a* to 101*d*.

The sheet surface detecting flag 62 is formed in an L shape as seen from the side surface (refer to FIGS. 8A and 8B) and is supported to be turnable with respect to the unit frame 26 on the lower side of the unit frame 26. The sheet surface detecting sensor 63 acts as a photo interrupter and is fixed at a position at which light emitting and light receiving portions can be switched between a light shielding state and a light transmitting state by the upper end portion of the L-shaped sheet surface detecting flag 62. The sheet surface detecting flag 62 and the sheet surface detecting sensor 63 act as detecting portions which switch between ON and OFF signals when an uppermost sheet S1 stacked on the sheet stacking table 52 reaches a predetermined position.

Figure 3:
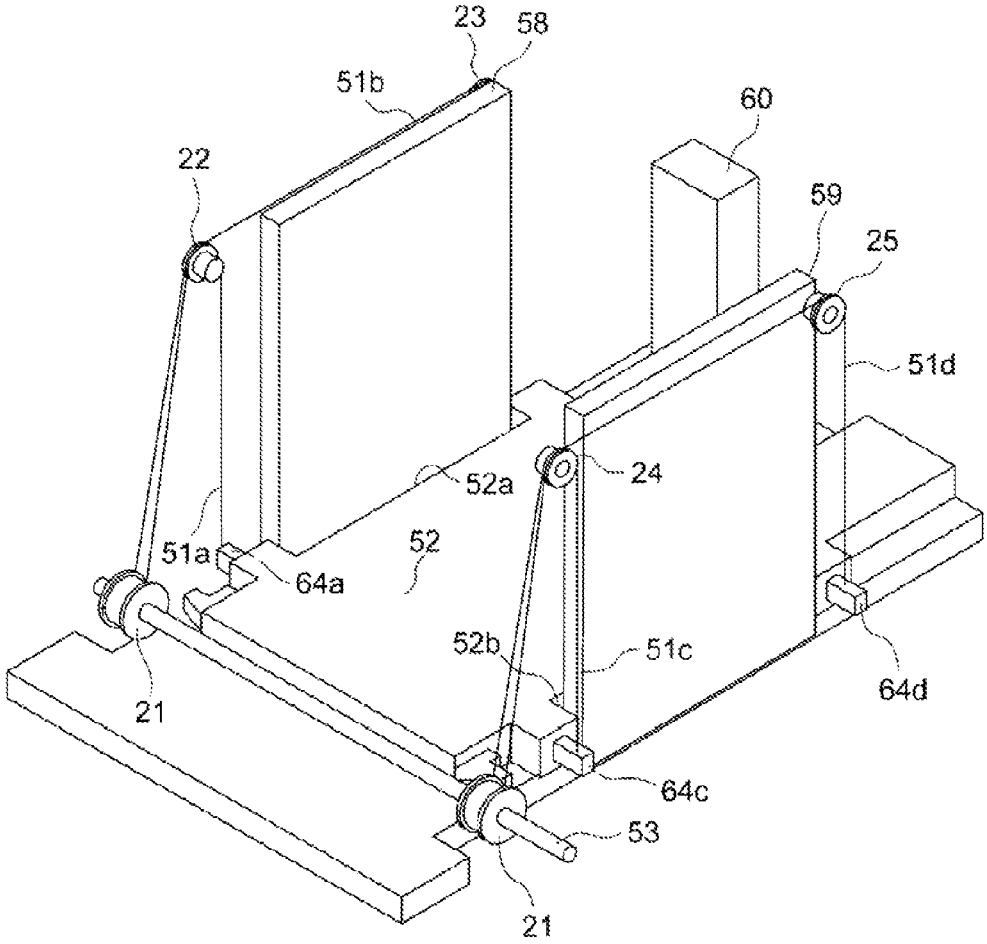
FIG. 3 is a perspective view illustrating the sheet feeding apparatus in a state where frame plates and the like are not shown.

FIG. 3 is a perspective view illustrating the sheet deck (sheet feeding apparatus) 2 according to the present embodiment in a state where the frame plates and the like are not shown. As illustrated in FIGS. 1 and 3, the sheet stacking table 52 is provided with a cutout portion 52*a* on the right side and a cutout portion 52*b* on the left side as one faces the pair of separating rollers 66 in a state where the sheet stacking table 52 is arranged between the frame plates 19 and 20. The sheet stacking table 52 is also provided with a cutout portion 52*c* on the upstream side in the sheet feeding direction. With these cutout portions 52*a*, 52*b*, and 52*c* are respectively movably engaged the reference-side side regulating member 58, the non-reference-side side regulating member 59, and the rear-end regulating member 60 erected on a side of the sheet deck 2.

Also, the sheet stacking table 52 has the wire hanging portions 64*a* and 64*b* formed to protrude outward from both the side portions of the cutout portion 52*a* and the wire hanging portions 64*c* and 64*d* formed to protrude outward from both the side portions of the cutout portion 52*b*. The wire hanging portions (at least parts of the sheet stacking portion) 64*a*, 64*b*, 64*c*, and 64*d* respectively movably pass through and are engaged with the opposed guide grooves 65*a*, 65*b*, 65*c*, and 65*d*. The sheet stacking table 52 is made of, e.g., a synthetic resin material, and the wire hanging portions 64*a* to 64*d* are made of the same material.

To each of the wire hanging portions 64*a*, 64*b*, 64*c*, and 64*d* is attached one end of each of wires 51*a*, 51*b*, 51*c*, and 51*d* as flexible members. The other end of each of the wires 51*a* to 51*d* is attached to each of pulleys 21 and 21 fixedly mounted respectively on both the end portions of a wire reel shaft 53 extending in a width direction of the sheet stacking table 52 to enable reeling.

As illustrated in FIGS. 1, 3, and 5, not-shown hole portions are formed at the lower portions of the frame plates 19 and 20 on a side on which the pair of separating rollers 66 is located. Both the ends of the wire reel shaft 53 are supported in these hole portions in a state of rotatably passing through the hole portions. To the upper sides of the wire reel shaft 53 in the frame plates 19 and 20 are respectively rotatably attached pulleys 22 and 24 in each of which circumferential grooves supporting the wire 51*a* or 51*c* are formed in two rows. To the proximities of the upper portions of the guide grooves 65*b* and 65*d* in the frame plates 19 and 20 are respectively rotatably attached pulleys 23 and 25 in each of which circumferential groove supporting the wire 51*b* or 51*d* is formed in one row.

In the present embodiment configured as above, when the pulse motor (driving source) 27 is driven based on a selected mode by control of the controller 5, the wire reel shaft 53 is rotated in a predetermined rotating direction and at predetermined rotating speed. As a result, the wire hanging portion 64*a* is reeled in or out by the wire 51*a*, the wire hanging portion 64*b* is reeled in or out by the wire 51*b*, the wire hanging portion 64*c* is reeled in or out by the wire 51*c*, and the wire hanging portion 64*d* is reeled in or out by the wire 51*d*. Thus, the sheet stacking table 52 performs a lifting and lowering operation with the cutout portions 52*a*, 52*b*, and 52*c* respectively along the reference-side side regulating member 58, the non-reference-side side regulating member 59, and the rear-end regulating member 60.

Figure 7:
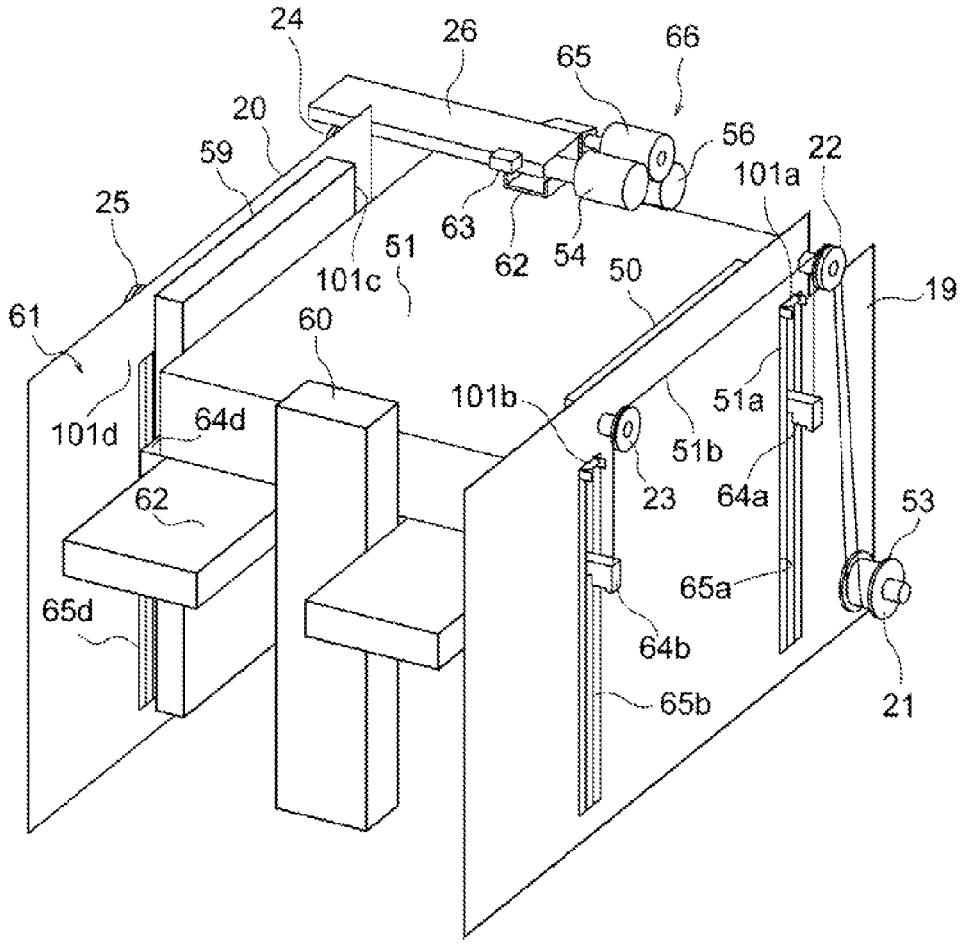
FIG. 7 is a perspective view illustrating the storing portion in a sheet stacking state.

Here, a configuration to lock the sheet stacking table 52 at the time of transporting the image forming apparatus will be described in details. FIG. 7 is a perspective view illustrating the storing portion of the sheet feeding apparatus in the present embodiment in a sheet stacking state.

As illustrated in FIGS. 1 and 7, the frame plates 19 and 20 are provided at the respective upper end portions of the guide grooves 65*a* to 65*d* of the storing portion 61 with the abutting portions 101*a*, 101*b*, 101*c*, and 101*d* on which the wire hanging portions 64*a* to 64*d* of the sheet stacking table 52 respectively abut from the lower sides. These abutting portions 101*a* to 101*d* are configured to make the sheet stacking table 52 lockable with respect to the storing portion 61 by making the wire hanging portions 64*a* to 64*d* of the lifting sheet stacking table 52 abut thereon at predetermined positions. The predetermined positions are positions (lock positions) exceeding upward a moving range of the sheet stacking table 52 at feeding controlling time at which the feeding roller 54 and the pulse motor 27 are controlled by the controller 5. That is, the lock positions are positions at which the sheet stacking table 52 is fixed and held so as to be prevented from moving by vibration and impact by making the wire hanging portions 64*a* to 64*d* abut on the corresponding abutting portions 101*a* to 101*d*.

All of the wire hanging portions 64*a* to 64*d* are located on the same level at both the side portions of the sheet stacking table 52. All of the abutting portions 101*a* to 101*d* are formed to be located on the same level in the storing portion 61 so as to receive equal abutting forces respectively from the corresponding wire hanging portions 64*a* to 64*d*. These abutting portions 101*a* to 101*d* are formed by bending outward parts corresponding to the uppermost portions of the respective guide grooves 65*a* to 65*d* in the frame plates 19 and 20 made of metals or the like. Alternatively, in a case where the frame plates 19 and 20 are made of synthetic resin materials, the abutting portions 101*a* to 101*d* are formed integrally with the guide grooves 65*a* to 65*d* by injection molding or the like.

The abutting portions 101*a* to 101*d* are provided to enable to abut on the sheet stacking table 52 and regulate movement of the sheet stacking table 52 at the aforementioned lock position, which is a position further above the height of the sheet stacking table 52 by control of the controller 5. The pulse motor 27, an after-mentioned one-way clutch 40, the guide grooves 65*a* to 65*d*, and the abutting portions 101*a* to 101*d* act as a lifting and lowering mechanism whose lifting and lowering driving is controlled by the controller 5.

Figure 10:
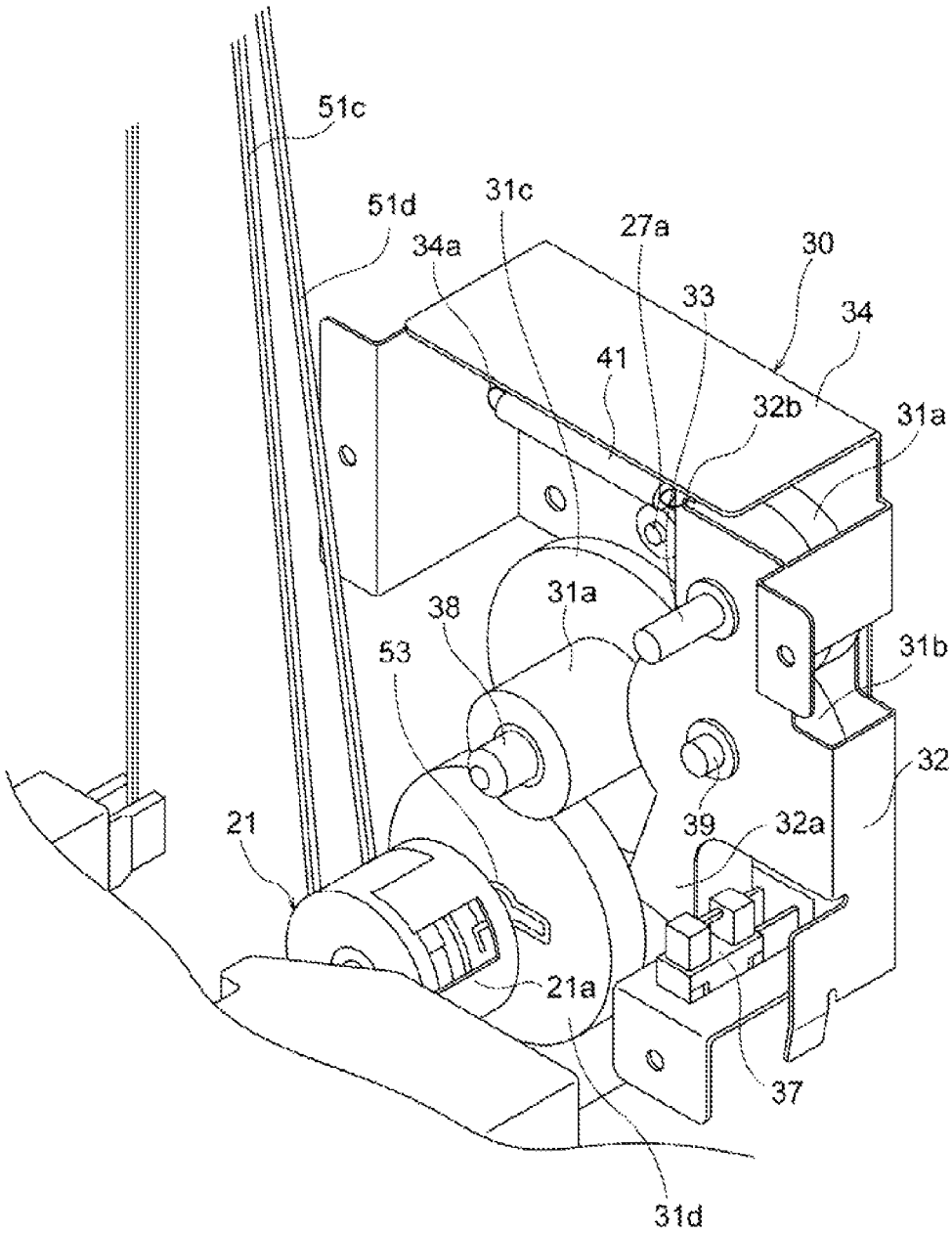
FIG. 10 is a perspective view illustrating a configuration of a driving unit which lifts a sheet stacking table of the present embodiment.

At each end portion of the wire reel shaft 53 is disposed a driving unit 30 which rotates the wire reel shaft 53 to lift the sheet stacking table 52 to a position enabling sheet feeding and holds the sheet stacking table 52 at this position enabling sheet feeding as illustrated in FIG. 10. The sheet stacking table 52 can be lifted by driving of the pulse motor 27 provided in the driving unit 30.

Figure 11:
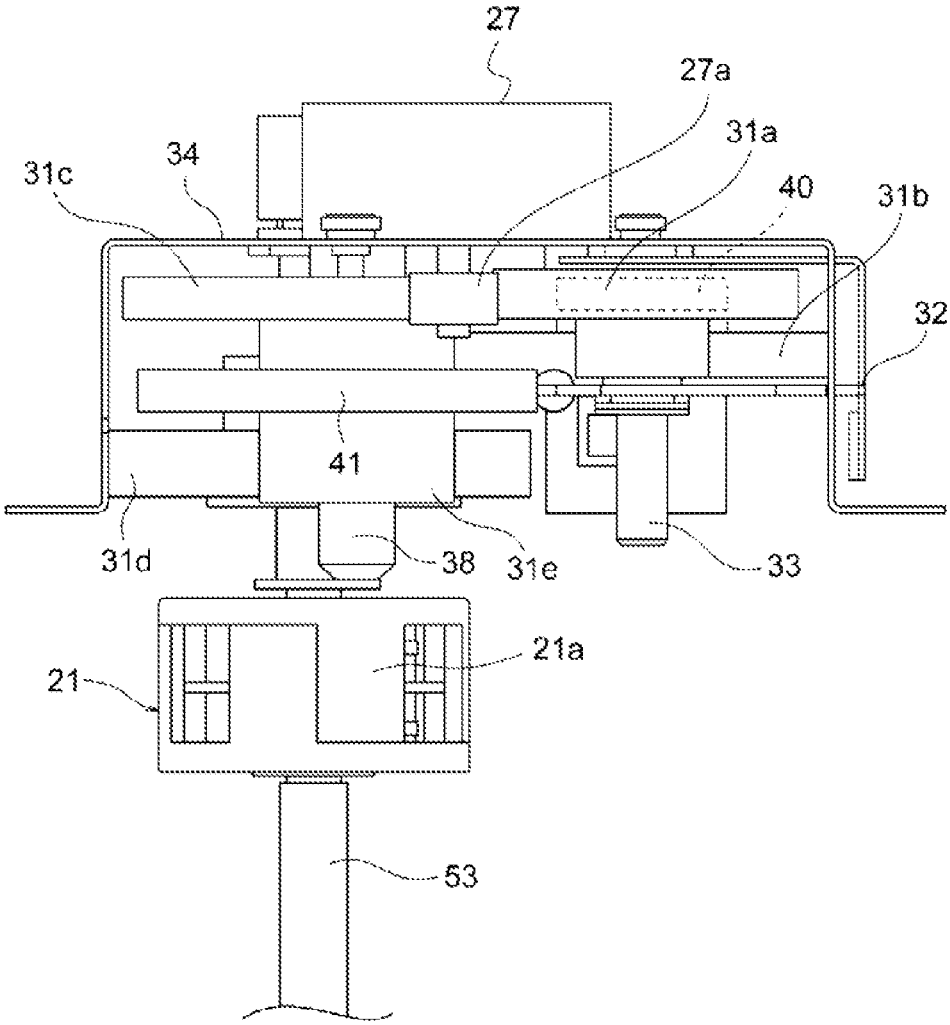
FIG. 11 is a plan view (upper view) of the driving unit.
Figure 12:
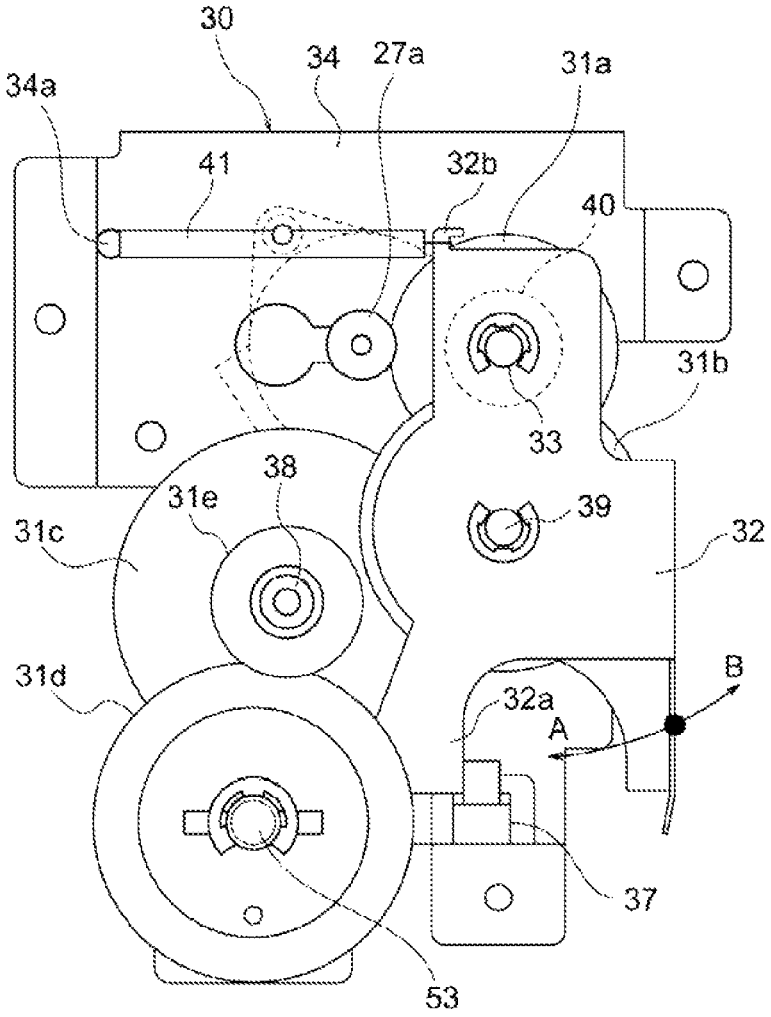
FIG. 12 is a side view of the driving unit.

The driving unit 30 includes the pulse motor 27, four stage gears 31*a*, 31*b*, 31*c* (including 31*e*), and 31*d* which transmit rotation of a motor gear 27*a* to the wire reel shaft 53, and a driving releasing member 32, as illustrated in FIGS. 10 to 12. The driving releasing member 32 holds the gear 31*b* and is swingably supported centering on a shaft 33 which rotatably supports the stage gear 31*a*. The driving unit 30 includes a supporting frame 34 which is fixed and supported to a side of a main body of the sheet deck 2. The driving releasing member 32 is supported to swing by the shaft 33 supported by this supporting frame 34 in a protruded state. A tension coil spring 41 is provided between an upper end portion 32*b* of the driving releasing member 32 and a locking portion 34*a* of the supporting frame 34.

The driving unit 30 includes a detecting sensor 37 as a photo interrupter at a position at which turning (swing) of a lower end portion 32*a* of the driving releasing member 32 can be detected. Also, the stage gear 31*d* is coaxially connected to the wire reel shaft 53 having the pulley 21 at an end portion thereof as illustrated in FIG. 11. Meanwhile, the pulley 21 illustrated in FIGS. 1, 3, 5, and 7 is shown with a pulley cover 21*a* illustrated in FIGS. 10 and 11 not shown.

The stage gear 31*a* has built therein the one-way clutch 40 (FIGS. 11 and 12). The one-way clutch 40 is provided between the pulse motor 27 and the sheet stacking table 52, is configured to be rotated freely in a lifting direction of the sheet stacking table 52 and to be locked in rotation in a lowering direction of the sheet stacking table 52, and can hold the sheet stacking table 52 at a lifting position.

When the door 2A (FIG. 4) is opened, the driving releasing member 32, which is a releasing portion releasing holding of the sheet stacking table 52 by the driving unit 30, is first turned in a direction of arrow B in FIG. 12 centering on the shaft 33 by a hooking portion (not shown) provided at the door 2A. This releases mesh between the stage gear 31*b* supported by the driving releasing member 32 and rotated by the pulse motor 27 and the stage gear 31*c* (31*e*) transmitting rotation of the pulse motor 27 to the wire reel shaft 53.

This releases transmission of driving of the pulse motor 27 to the wire reel shaft 53, along with which holding of the sheet stacking table 52 by the one-way clutch 40 of the driving unit 30 is released to cause the wire reel shaft 53 to be rotatable. As a result, by weight of the sheet S stacked on the sheet stacking table 52 and the sheet stacking table itself applied to the wire reel shaft 53 via the wires 51*a* to 51*d*, the wire reel shaft 53 is rotated in a direction of reeling out the wires 51*a* to 51*d*. Thus, the sheet stacking table 52 is lowered to a lowermost stacking position.

Subsequently, when stacking of the sheet bundle (S) to the sheet stacking table 52 at the stacking position is finished, and the door 2A is closed, the driving releasing member 32 is pressed by a thrusting portion (not shown) provided at the door 2A and is turned to a direction of arrow A in FIG. 12. By doing so, the stage gear 31*b* supported by the driving releasing member 32 and the stage gear 31*c* (31*e*) mesh with each other to bring a state in which a driving force of the pulse motor 27 can be transmitted to the wire reel shaft 53.

When the detecting sensor 37 detects the turning of the driving releasing member 32, the controller 5 drives the pulse motor 27 to be rotated in a lifting direction of the sheet stacking table 52 based on a detection signal from the detecting sensor 37. Thus, the wire reel shaft 53 is rotated in a direction of reeling in the wires, the wires 51*a*, 51*b*, 51*c*, and 51*d* are reeled in by the pulleys 21 and 21, and the sheet stacking table 52 is lifted.

At this time, the controller 5, which drives the pulse motor 27 to be rotated in the lifting direction, further drives the pulse motor 27 to be rotated in the same direction even after the wire hanging portions 64*a* to 64*d* as parts of the sheet stacking table 52 abut on the abutting portions 101*a* to 101*d* to cause the pulse motor 27 to step out and thereafter renders the pulse motor 27 non-conductive. As a result of this, the sheet stacking table 52 is locked by the one-way clutch 40 in a state where the wire hanging portions 64*a* to 64*d* abut on the abutting portions 101*a* to 101*d*.

Figure 8A:
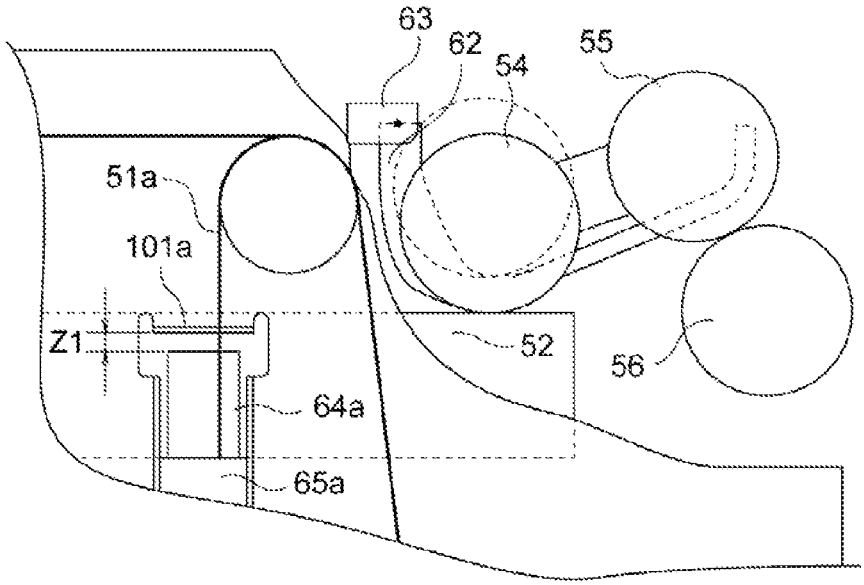
FIG. 8A is a side view illustrating the apparatus as seen in a direction of arrow A (at the time of feeding)
Figure 8B:
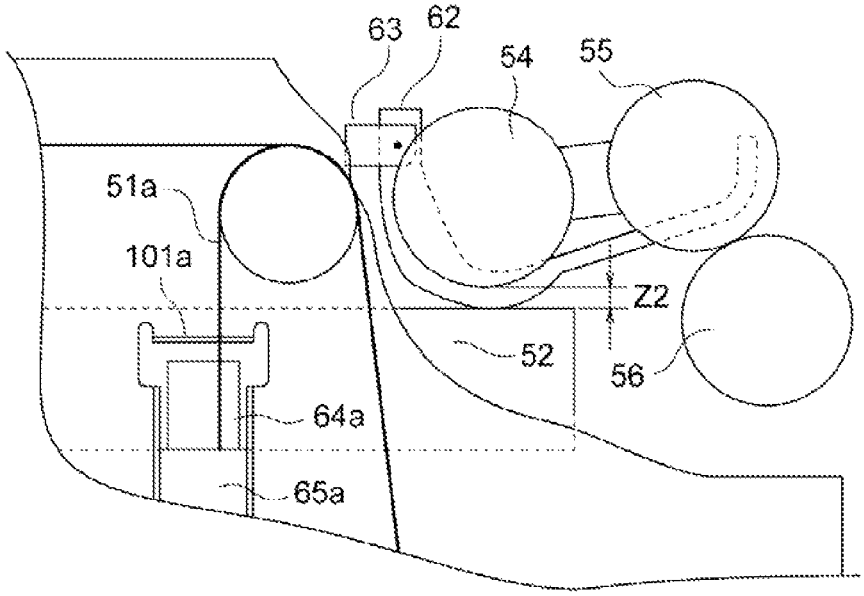
FIG. 8B is a side view illustrating the apparatus as seen in a direction of arrow A (at the time of transportation)

FIGS. 8A and 8B are side views illustrating the apparatus as seen in a direction of arrow A in FIG. 5. FIG. 8A illustrates a state at the time of feeding while FIG. 8B illustrates a state at the time of transportation. FIGS. 8A and 8B are illustrated in a state where no sheet is stacked on the sheet stacking table 52.

As illustrated in FIG. 8A, the abutting portions 101*a* to 101*d* are configured not to interfere with sheet feeding when the pulse motor 27 is driven by the controller 5 based on a signal from the sheet surface detecting sensor 63, and the sheet stacking table 52 is lifted to a sheet feeding position. That is, the respective positions of the abutting portions 101*a* to 101*d* are set so that a space Z1 having a predetermined length or longer can be provided between each of the wire hanging portions 64*a* to 64*d* and each of the abutting portions 101*a* to 101*d* even in a state where no sheet is stacked.

Further, as illustrated in FIG. 8B, control by the controller 5 except control by the controller 5 to lift or lower the sheet stacking table 52 based on a signal of the sheet surface detecting sensor 63 is as follows. That is, when the sheet stacking table 52 presses up the sheet surface detecting flag 62 and is lifted, the controller 5 makes the wire hanging portions 64*a* to 64*d* abut on the abutting portions 101*a* to 101*d* and drives the pulse motor 27 further in the same direction from this state to cause the pulse motor 27 to step out, as described above. Subsequently, the controller 5 shuts off conduction to the pulse motor 27. Thus, the sheet stacking table 52 is held at the lock position exceeding upward the moving range of the sheet stacking table 52 at the time of sheet surface control by the controller 5.

In this case, the controller 5 retracts the feeding roller 54 above the sheet stacking table 52, and in the retracting state, the controller 5 leaves a predetermined space Z2 between the feeding roller 54 and the sheet stacking table 52. In other words, the abutting portions 101*a* to 101*d* function not to make the sheet stacking table 52 abut on the feeding roller 54 in a state where the wire hanging portions 64*a* to 64*d* of the sheet stacking table 52 abut thereon. In this manner, respective positions are set so as to prevent scratches and breakage to the feeding roller 54 caused by vibration and impact at the time of transportation.

Also, the controller 5 performs control in the following different modes when the opened door 2A is closed depending on an operating state of a not shown manual switch arranged in the apparatus main body 10.

Figure 9:
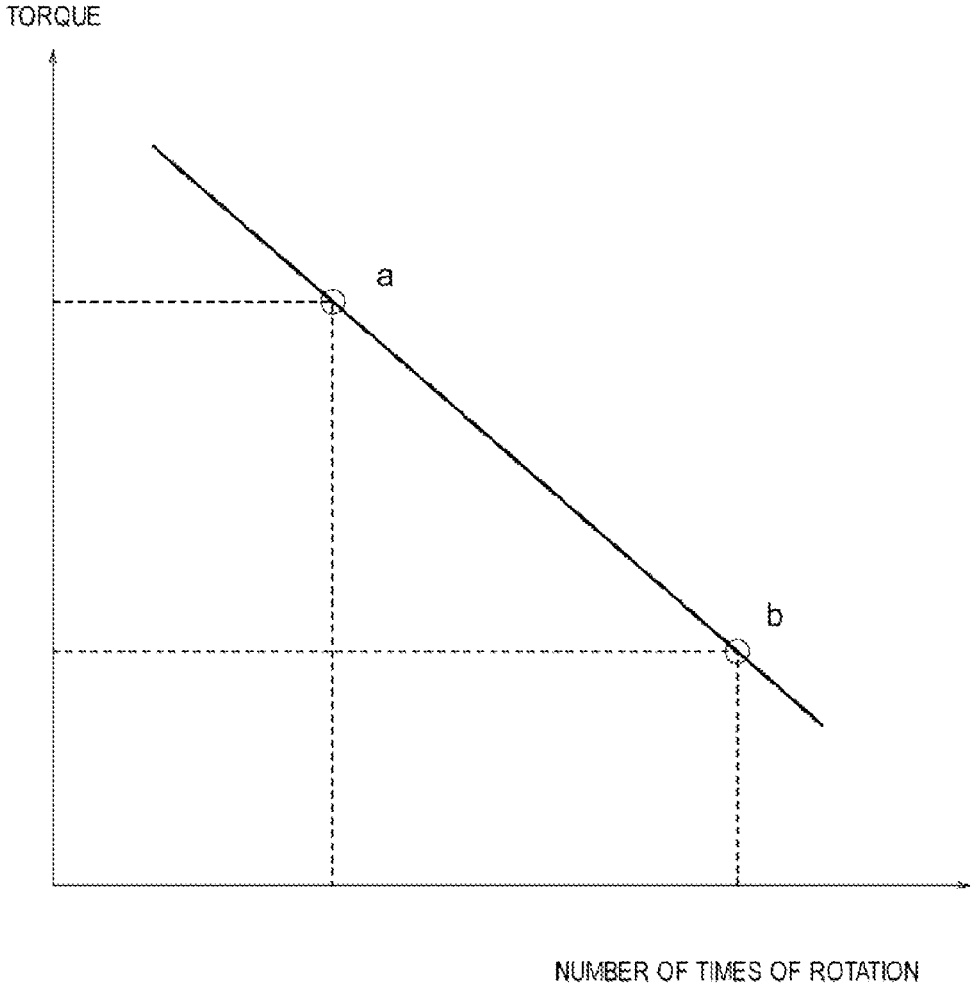
FIG. 9 is a characteristic graph illustrating the characteristics of the number of times of rotation and the torque of a pulse motor in the present embodiment.

That is, as for the characteristics of the pulse motor 27, the higher the number of times of rotation of the pulse motor 27 is, the more the torque of the motor is lowered, as illustrated in the graph in FIG. 9. At the time of actual use such as an actual feeding operation, the number of times of rotation and the torque of the pulse motor 27 are set so that the pulse motor 27 may not so-to-speak "step out" even in a case where sheets are fully stacked on the sheet stacking table 52. The number of times of rotation and the torque at this time are in a normal mode (feeding mode) set as "a" in FIG. 9.

The controller 5 also has a shipping mode (lock mode) in which the pulse motor 27 is rotated with a higher number of times of rotation than that at the time of actual use in the normal mode (feeding mode), and the number of times of rotation and the torque at this time are set as "b" in FIG. 9. The torque at this time is set as minimum necessary torque in a state where there is no sheet on the sheet stacking table 52.

In this manner, the controller 5 has the normal mode for normal control, which is used at the time of sheet feeding by the feeding roller 54, and the shipping mode for accelerating control, in which the sheet stacking table 52 is lifted fast with lower torque and faster rotation than those in the feeding mode, so as to be switchable. The controller 5 drives the pulse motor 27 to be rotated until the pulse motor 27 steps out at the time of switching the mode to the shipping mode. Switching between the modes is performed by an operation of the aforementioned manual switch (not shown).

In the present embodiment configured as above, when the door 2A is opened as in FIG. 4, the sheet stacking table 52 in a lifted state rotates the wire reel shaft 53 in a reel-out direction via the wires 51*a* to 51*d* by its own weight by action of the hooking portion (not shown) at the door 2A. Thus, the sheet stacking table 52 is lowered from the position enabling sheet feeding to the lowermost stacking position enabling sheet stacking as illustrated in FIG. 4.

Subsequently, when the aforementioned manual switch is switched to the normal mode side, sheet refilling to the sheet stacking table 52 is finished, and the door 2A is closed, the controller 5 drives the pulse motor 27 in a reel-in direction with the number of times of rotation and the torque shown as "a" in FIG. 9 based on a signal of the detecting sensor 37. Thus, the wires 51*a* to 51*d* are respectively reeled in by the pulleys 21 and 21, and the sheet stacking table 52 is lifted within the moving range of the sheet stacking table 52 at the time of sheet surface control by the controller 5 as illustrated in FIG. 5.

Thereafter, when the uppermost sheet S1 of the sheet bundle (S) stacked on the sheet stacking table 52 abuts on the sheet surface detecting flag 62 as illustrated in FIG. 7 to cause the sheet surface detecting flag 62 to be turned, the ON/OFF signals of the sheet surface detecting sensor 63 are switched. Thus, by the controller 5, which is based on a signal of the sheet surface detecting sensor 63, the sheet stacking table 52 is moved to a height position enabling the uppermost sheet S1 to be sent at the feeding roller 54 and enter a nip of the pair of separating rollers 66 smoothly and is controlled in lifting and lowering to keep this position.

Figure 6A:
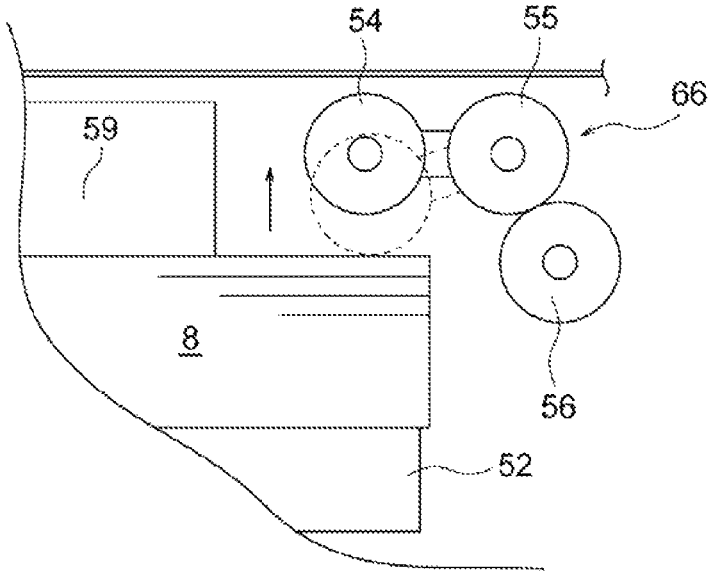
FIG. 6A is a side view illustrating the apparatus as seen in a direction of arrow A in FIG. 5 (a retracted state of a feeding roller)
Figure 6B:
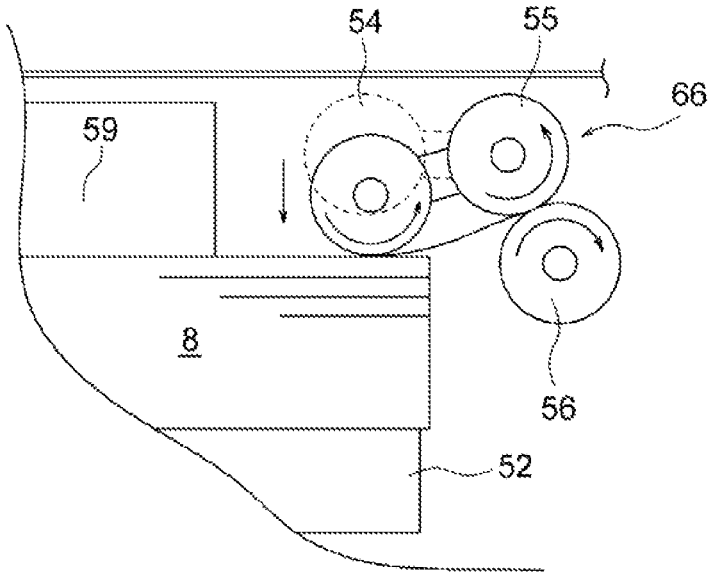
FIG. 6B is a side view illustrating the apparatus as seen in a direction of arrow A in FIG. 5 (a feeding state of the feeding roller)

At this time, the feeding roller 54 abuts on the uppermost sheet of the sheet bundle (S) and is rotated in a feeding direction based on a sent feeding signal as illustrated in FIG. 6B to send the uppermost sheet to the pair of separating rollers 66 on the downstream side. Thus, the pair of separating rollers 66 separates and feeds the sheet S sent from the feeding roller 54 one by one and sends the sheet toward the image forming portion 3 (refer to FIG. 2). Also, at this time, when the feeding roller 54 sends the sheet to the pair of separating rollers 66, the feeding roller 54 is retracted to the upper side of the sheet to prevent interference with separation of the sheet S at the pair of separating rollers 66 as illustrated in FIG. 6A and is operated not to abut on the sheet S. The feeding roller 54 repeats the above operation every time the feeding signal is sent and sends the sheet S toward the image forming portion 3 one by one.

In this manner, the feeding roller 54 moves to a feeding position (FIG. 6B), in which the feeding roller 54 contacts the uppermost sheet S1 on the sheet stacking table 52 at the time of starting feeding to feed this sheet S1, and a retracted position (FIG. 6A), in which the feeding roller 54 is retracted to the upper side of the sheet during sheet feeding. The abutting portions 101*a* to 101*d* as abutting portions abut on the sheet stacking table 52 before the feeding roller 54 abuts on the sheet stacking table 52 in a case where the feeding roller 54 is at the retracted position (refer to FIG. 8B).

On the other hand, at the time of transportation such as the time of factory shipment, the door 2A is opened to lower the sheet stacking table 52 to the lowermost position. The sheet bundle is removed in a case where the sheet bundle exists on the sheet stacking table 52, and the aforementioned manual switch is switched to the shipping mode side. When the door 2A is closed in this state, the controller 5 drives the pulse motor 27 in a reel-in direction of the wire reel shaft 53 with the number of times of rotation and the torque shown as "b" in FIG. 9 and lifts the sheet stacking table 52. The lifting amount at this time is set so that the sheet stacking table 52 may abut on the sheet surface detecting flag 62 to make the ON/OFF signals of the sheet surface detecting sensor 63 switched and be further lifted higher than Z1 in FIG. 8A.

Subsequently, when the sheet stacking table 52 is lifted, and the wire hanging portions 64*a* to 64*d* abut on the abutting portions 101*a* to 101*d*, the pulse motor 27, which attempts to be rotated further in the same direction, steps out. However, since the torque at this time is minimum necessary torque in a state where there is no sheet on the sheet stacking table 52, forces applied to the wire hanging portions 64*a* to 64*d* and the abutting portions 101*a* to 101*d* are minor, and the abutment has no problem.

In this manner, by switching the mode to the shipping mode, the pulse motor 27 is driven to be rotated until the pulse motor 27 steps out at the lock position exceeding upward the moving range of the sheet stacking table 52 at the time of sheet surface control by the controller 5, and thus the sheet stacking table 52 can be locked reliably. Accordingly, at the time of shipment, the sheet stacking table 52 can be locked easily and reliably only with the control of the pulse motor 27. Thus, scratches and breakage caused by vibration and impact at the time of transportation in a state of building the sheet deck 2 in the image forming apparatus 1 or in a state of the sheet deck 2 alone can be prevented by a simple configuration that does not cause a cost increase. Also, at this time, since the sheet surface detecting sensor 63 is in a state of sheet residing, the sheet stacking table 52 will not be lifted further even when a user turns on main power in this state. Accordingly, the sheet stacking table 52 or peripheral members will not be scratched or broken when the sheet stacking table 52 is lifted.

Also, in a case where the apparatus is first used after transportation, when the door 2A is opened by the user, the controller 5 detects the opening, and the driving releasing member 32 is turned by the hooking portion (not shown), and mesh between the stage gear 31*b* and the stage gear 31*c* (31*e*) is released. By doing so, holding of the sheet stacking table 52 by the one-way clutch 40 is released, and by weight of the sheet stacking table itself, the wire reel shaft 53 is rotated in a direction of reeling out the wires 51*a* to 51*d*, and the sheet stacking table 52 is lowered to the lowermost stacking position.

Subsequently, when stacking of the sheet bundle to the sheet stacking table 52 is finished, the aforementioned manual switch (not shown) is switched to the normal mode side, and the door 2A is closed, the driving releasing member 32 is pressed by the thrusting portion (not shown) at the door 2A, and the stage gear 31*b* and the stage gear 31*c* (31*e*) mesh with each other. Subsequently, when the turning of the driving releasing member 32 is detected at the detecting sensor 37, the controller 5 synchronously rotates the pulse motor 27, which has stepped out, again, and lifts the sheet stacking table 52 via the wires 51*a* to 51*d*.

Meanwhile, as described above, although the abutting portions 101*a* to 101*d* are made of metals or synthetic resin materials, and the wire hanging portions 64*a* to 64*d* are made of synthetic resin materials, these may be made in the following manner instead of this manner. For example, at least either the abutting portions 101*a* to 101*d* or the wire hanging portions 64*a* to 64*d* may be made of elastic members having elasticity. In this case, the lock state by the abutment between the abutting portions 101*a* to 101*d* and the wire hanging portions 64*a* to 64*d* can be further stabilized.

In the present embodiment, the sheet stacking table 52 is fixed (locked) by making the pulse motor 27 step out and making the wire hanging portions 64*a* to 64*d* abut on the abutting portions 101*a* to 101*d*. However, the abutting portions 101*a* to 101*d* may be substituted for in a manner of the following modification example.

Figure 13A:
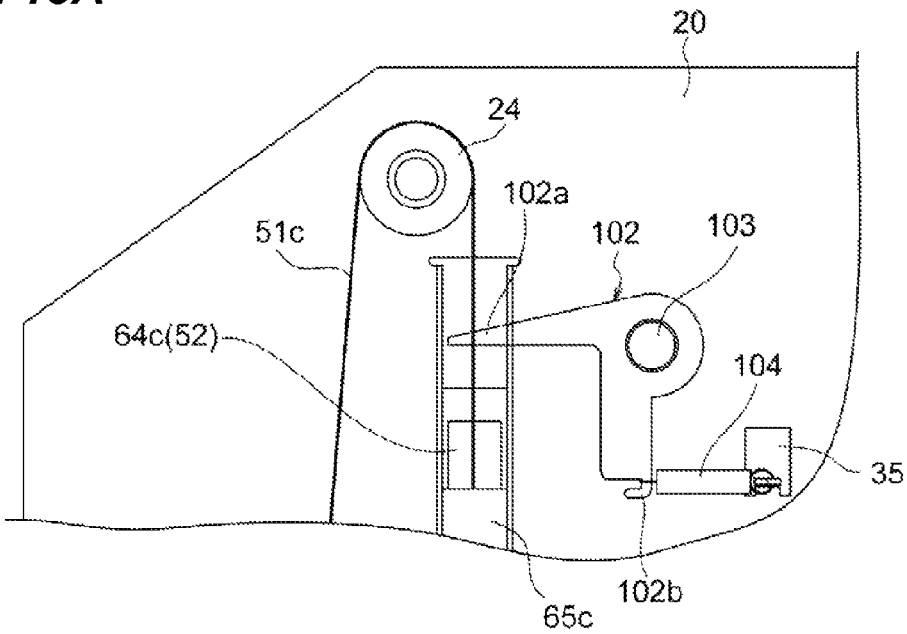
FIG. 13A is a left side view illustrating a configuration to fix the sheet stacking table in a modification example.

For example, as illustrated in FIG. 13A, a shaft 103 is fixed in the frame plate 20 in a protruded state, and an approximately L-shaped abutting member (abutting portion) 102 is turnably supported to the shaft 103 with its upper end portion 102*a* located in proximity to the upper end portion of the guide groove 65*c*. Also, a locking member 35 is fixed at a position of the frame plate 20 opposed to a lower end portion 102*b* of the abutting member 102, and a tension coil spring (elastic body) 104 is stretched between the lower end portion 102*b* and the locking member 35. Similar abutting members 102 are arranged at positions corresponding to the other wire hanging portions 64*a*, 64*b*, and 64*d*.

Figure 13B:
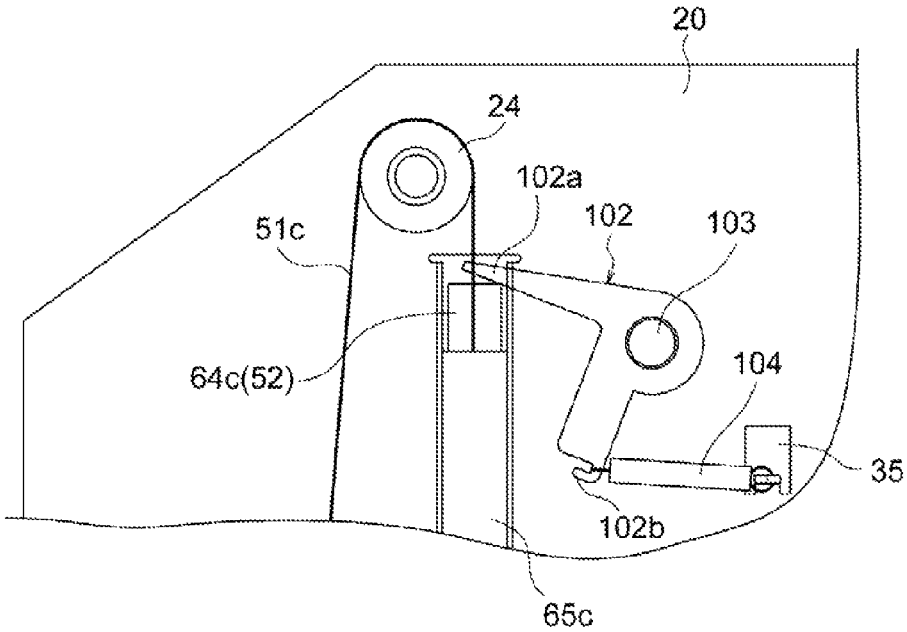
FIG. 13B is a left side view illustrating a configuration to fix the sheet stacking table in the modification example.

Thus, each of the abutting members 102 is in a state where a force is applied by each tension coil spring 104 in a direction in which the upper end portion 102*a* applies a force to each of the wire hanging portions 64*a* to 64*d* of the sheet stacking table 52. Consequently, as in FIG. 13B, the sheet stacking table 52 can be fixed (locked) by elastic forces of the abutting members 102 at the time of transportation, and similar effects to those in the aforementioned embodiment can be obtained.

Also, in the present modification example as well as in the aforementioned embodiment, an elastic force of each abutting member 102 is set so that each abutting member 102 may function not to make the sheet stacking table 52 abut on the feeding roller 54 in a state of abutting each of the wire hanging portions 64*a* to 64*d* of the sheet stacking table 52.

Since the sheet stacking table 52 can be locked by the upper end portion 102*a* due to the elastic force of each abutting member 102, the above configuration is a simple configuration, does not cause a cost increase, and can prevent scratches and breakage caused by vibration and impact at the time of transportation reliably. Also, at this time, since the sheet surface detecting sensor 63 is in a state of sheet residing, the sheet stacking table 52 will not be lifted even when the user turns on power in this state. Accordingly, the sheet stacking table 52 or peripheral members will not be scratched or broken when the sheet stacking table 52 is lifted. Also, the sheet stacking table 52 can be fixed and held at the lock position exceeding upward the moving range without making the pulse motor 27 step out. It is to be understood that the controller 5 has the normal mode and the shipping mode in the present modification example as well.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-086661, filed Apr. 8, 2011, which is hereby incorporated by reference herein in its entirety.

What is claimed is:

1. A sheet feeding apparatus comprising:

a storing portion which has a sheet stacking portion to enable lifting and lowering;

a feeding portion which feeds a sheet stacked on the sheet stacking portion;

a lifting and lowering mechanism which lifts and lowers the sheet stacking portion;

a pulse motor, provided on the lifting and lowering mechanism, which lifts the sheet stacking portion;

an abutting portion which makes the sheet stacking portion lifted by the pulse motor abut thereon at a predetermined position and makes the sheet stacking portion lockable with respect to the storing portion;

a one-way clutch which is provided between the pulse motor and the sheet stacking portion, is rotated freely in a lifting direction of the sheet stacking portion, and is locked in rotation in a lowering direction of the sheet stacking portion; and a controller which controls the pulse motor to be rotated to lift the sheet stacking portion in the lifting direction, and further controls the pulse motor to be rotated in the same direction even after the sheet stacking portion abuts on the abutting portion to cause the pulse motor to step out, and thereafter renders the pulse motor non-conductive, wherein the controller has a feeding mode in which the sheet stacking portion is lifted by the pulse motor to feed the sheet by the feeding portion and a lock mode in which the sheet stacking portion is lifted by the pulse motor with lower torque and faster rotation than in the feeding mode, and the pulse motor is step out in the lock mode.

2. The sheet feeding apparatus according to claim 1, wherein the predetermined position is a position exceeding upward a moving range of the sheet stacking portion at sheet feeding controlling time at which the feeding portion and the pulse motor are controlled by the controller.

3. The sheet feeding apparatus according to claim 1, wherein the abutting portion at the predetermined position does not make the sheet stacking portion abut on the feeding portion in a state where the sheet stacking portion abuts thereon.

4. The sheet feeding apparatus according to claim 1, wherein the lifting and lowering mechanism has a guide portion which guides movement of the sheet stacking portion and is provided at an upper end portion thereof with the abutting portion.

5. The sheet feeding apparatus according to claim 1, wherein the abutting portion is made of a member having an elastic force.

6. An image forming apparatus comprising:

an image forming portion which forms an image on a sheet; and a sheet feeding apparatus which supplies the image forming portion with the sheet, comprising:

a storing portion which has a sheet stacking portion to enable lifting and lowering;

a feeding portion which feeds a sheet stacked on the sheet stacking portion;

a lifting and lowering mechanism which lifts and lowers the sheet stacking portion;

a pulse motor, provided on the lifting and lowering mechanism, which lifts the sheet stacking portion;

an abutting portion which makes the sheet stacking portion lifted by the pulse motor abut thereon at a predetermined position and makes the sheet stacking portion lockable with respect to the storing portion;

a one-way clutch which is provided between the pulse motor and the sheet stacking portion, is rotated freely in a lifting direction of the sheet stacking portion, and is locked in rotation in a lowering direction of the sheet stacking portion; and a controller which controls the pulse motor to be rotated to lift the sheet stacking portion in the lifting direction, and further controls the pulse motor to be rotated in the same direction even after the sheet stacking portion abuts on the abutting portion to cause the pulse motor to step out, and thereafter renders the pulse motor non-conductive, wherein the controller has a feeding mode in which the sheet stacking portion is lifted by the pulse motor to feed the sheet by the feeding portion and a lock mode in which the sheet stacking portion is lifted by the pulse motor with lower torque and faster rotation than in the feeding mode, and the pulse motor is step out in the lock mode.

7. The image forming apparatus according to claim 6, wherein the predetermined position is a position exceeding upward a moving range of the sheet stacking portion at sheet feeding controlling time at which the feeding portion and the pulse motor are controlled by the controller.

8. The image forming apparatus according to claim 6, wherein the abutting portion at the predetermined position does not make the sheet stacking portion abut on the feeding portion in a state where the sheet stacking portion abuts thereon.

9. The image forming apparatus according to claim 6, wherein the lifting and lowering mechanism has a guide portion which guides movement of the sheet stacking portion and is provided at an upper end portion thereof with the abutting portion.

10. The image forming apparatus according to claim 6, wherein the abutting portion is made of a member having an elastic force.

* * * * *